US009346595B2

(12) United States Patent
Soltz et al.

(10) Patent No.: US 9,346,595 B2
(45) Date of Patent: May 24, 2016

(54) BOTTLE CAP WITH COSMETIC KIT

(71) Applicant: Tali Corp., San Francisco, CA (US)

(72) Inventors: Tal Soltz, San Francisco, CA (US); Imraan Aziz, Oakland, CA (US); Thomas E. King, San Francisco, CA (US); Michael J. Strasser, San Francisco, CA (US)

(73) Assignee: Tali Corp., San Francisco, CA (US)

( * ) Notice: Subject to any disclaimer, the term of this patent is extended or adjusted under 35 U.S.C. 154(b) by 0 days.

(21) Appl. No.: 14/616,645

(22) Filed: Feb. 6, 2015

(65) Prior Publication Data

US 2016/0096668 A1 Apr. 7, 2016

Related U.S. Application Data

(60) Provisional application No. 62/059,137, filed on Oct. 2, 2014.

(51) Int. Cl.

*B65D 51/24* (2006.01)
*B65D 41/04* (2006.01)
*A45D 40/18* (2006.01)

(52) U.S. Cl.

CPC ..... *B65D 51/24* (2013.01); *A45D 40/18* (2013.01); *B65D 41/04* (2013.01)

(58) Field of Classification Search

CPC .. B65D 51/28; B65D 51/2807; B65D 25/325; B65D 25/32; B65D 25/28; B65D 51/24; B65D 41/04; B65D 41/0485; A45D 40/222; A45D 40/22; A45D 40/18; A45D 40/24; A45D 42/02

USPC ..... 215/227, 228, 243, 237, 235, 397, 396; 220/212, 254.3, 259.1, 522, 521, 220/212.5, 740, 756, 839, 837, 836, 810, 220/324, 315; 206/581; 16/425

See application file for complete search history.

(56) References Cited

U.S. PATENT DOCUMENTS 1,242,994 A * 10/1917 Skiff ..... B65D 23/106 16/425
3,307,752 A * 3/1967 Anderson ..... B65D 23/108 215/306

(Continued)

FOREIGN PATENT DOCUMENTS

EP 1743546 A1 * 1/2007 ..... A45D 40/24
KR 1020120132141 A 12/2012

(Continued)

OTHER PUBLICATIONS

FreshwaterSystems.com, "Lid with Pour Cap and Handle for 1 Gallon Glass Jar Turquoise Splash", Wayback Machine, https://web.archive.org/web/20140414025953/http://www.freshwatersystems.com/p-8398-lid-with-pour-cap-and-handle-for-1-gallon-glass-jar-turquoise-splash.aspx, Apr. 14, 2014.*

(Continued)

*Primary Examiner* — Robert J Hicks
(74) *Attorney, Agent, or Firm* — Loginov & Associates, PLLC; William A. Loginov

(57) ABSTRACT

A cap for a bottle containing a cosmetic reservoir is cylindrical (not necessarily radially symmetric) and defines an inner volume containing at least one reservoir for cosmetics, the reservoir being accessible when the lid is opened and inaccessible when the lid is closed. The reservoir is refillable and can be a removable tray. The reservoir can be defined by a central wall dividing the reservoir into two or more cosmetic reservoirs. In another embodiment, two or more trays of cosmetics can be stacked, one upon the other. A method for carrying and dispensing cosmetics within a cap for a bottle includes opening the lid and filling a cosmetic reservoir within the cap with a cosmetic; opening the lid to access and remove a portion of the cosmetic from the reservoir; and applying the cosmetic and closing the lid.

14 Claims, 9 Drawing Sheets

(56) References Cited

U.S. PATENT DOCUMENTS

| | | | | |
|---|---|---|---|---|
| 4,165,815 | A * | 8/1979 | Vetter | B65D 21/0228 15/244.1 |
| 6,478,155 | B2 | 11/2002 | Bunyan | |
| 7,055,709 | B1 | 6/2006 | Esau | |
| 7,337,497 | B2 | 3/2008 | Seidler et al. | |
| 7,503,453 | B2 | 3/2009 | Cronin et al. | |
| 7,854,104 | B2 | 12/2010 | Cronin et al. | |
| D672,609 | S * | 12/2012 | Aziz et al. | D7/507 |
| 2006/0016819 | A1 | 1/2006 | Paslawski et al. | |
| 2006/0191932 | A1 | 8/2006 | Bocola | |
| 2007/0205176 | A1 * | 9/2007 | Karp | A45D 33/26 215/237 |
| 2010/0294739 | A1 * | 11/2010 | Morris, III | B65D 51/28 215/227 |
| 2012/0145713 | A1 * | 6/2012 | Jung | A47J 41/0011 220/254.3 |
| 2014/0314466 | A1 * | 10/2014 | Hartstock et al. | A45D 34/045 401/126 |

FOREIGN PATENT DOCUMENTS

| | | | |
|---|---|---|---|
| KR | 101271359 | B1 | 6/2013 |
| WO | 2006034162 | A1 | 3/2006 |

OTHER PUBLICATIONS

Sanchez, Janaise. "Avex Autospout Water Bottle Review". Wayback Machine, https://web.archive.org/web/20130513215212/http://www.freshairjunkie.com/index.php/2013/04/avex-autospout-water-bottle-review/, May 13, 2013.*

Maria. "Lifefactory Glass Beverage Bottles." Wayback Machine, https://web.archive.org/web/20120302222842/http://change-diapers.com/2012/02/lifefactory-glass-beverage-bottles, Mar. 2, 2012.*

* cited by examiner

BOTTLE CAP WITH COSMETIC KIT

RELATED APPLICATIONS

This application claims the benefit of U.S. Provisional Application Ser. No. 62/059,137, filed Oct. 2, 2014, entitled BOTTLE CAP WITH COSMETIC KIT, the entire disclosure of which is herein incorporated by reference.

FIELD OF THE INVENTION

This invention relates to a cap for bottles and more particularly to a cap that includes a cosmetic kit.

BACKGROUND OF THE INVENTION

Active lifestyles are mobile lifestyles, and water remains an essential part of life, so portable and safe liquid vessels are a part of modern life. Renewable and reusable water vessels offer and environmentally friendly alternative to the ubiquitous disposable plastic bottle. While convenient when introduced, the plastic bottle is now recognized as wasteful. Simple water can now be transformed into sports drinks and energy supplements by the introduction of concentrated additives. Another problem with conventional plastic bottles is the health risk posed by the various chemical ingredients used in creating the bottles. Some of the chemical components can pass into the contained liquids by a leaching process, placing the health of the consumer at risk. This can be particularly troublesome to the health conscious consumer.

A glass bottle is refillable, reusable and can be cleaned as needed. Glass vessels are not prone to contaminating the contents by leaching. Glass containers, which are predominantly silicon-dioxide structures, are stable and relatively free from contamination of their contents. However, glass bottles can be slippery to hold and are prone to breakage if dropped.

Users of glass bottles can find themselves with dry lips. Lip glosses and lip balms are conventional remedies for dry lips. However, water bottle use can remove lip gloss. Women who use the bottle can find themselves needing more lip gloss or another cosmetic to maintain their appearance. Examples of cosmetics are base creams, eye shadow, eve liners, blushes and the like.

It would be desirable to provide a protective sleeve around the bottle that can be removed for cleaning and provides an adequate grip when in use and a resilient buffer if dropped.

SUMMARY OF THE INVENTION

The present invention overcomes the disadvantages of the prior art by providing a cap for a bottle containing a cosmetic reservoir. The cap is cylindrical and defines an inner volume containing at least one reservoir for cosmetics, the reservoir being accessible when the lid is opened and inaccessible when the lid is closed. The reservoir is refillable and can be a removable tray. A cap for a bottle is comprised of a threaded section for engaging with the bottle; a reservoir chamber for receiving a cosmetic; a barrier wall disposed between the threaded section and the reservoir chamber; a lid configured to enclose the reservoir chamber and to provide selective access to the cosmetic kit. The cosmetic received within the reservoir chamber can be depleted and subsequently refilled. The reservoir chamber can receive a removable tray, the removable tray being configured to receive the cosmetic. The reservoir chamber can comprise a dividing wall that defines a plurality of distinct reservoir chambers for receiving a plurality of cosmetics. At least two reservoirs can be stacked, one upon the other. The cap is provided with a handle set at an angle relative to the cap that acts as a stop to the lid. A method for carrying and dispensing cosmetics within a cap for a bottle is comprised of the steps of opening a lid and filling a cosmetic reservoir within the cap with a cosmetic; opening the lid to access and remove a portion of the cosmetic from the cosmetic reservoir; and applying the cosmetic; and closing the lid. The opening of the lid is stopped by contact with the handle. The closing of the lid creates an annular seal to contain the enclosed cosmetics. The handle is off set at an angle of 60 degrees relative to the cap. A bottle system is comprised of a bottle for receiving a liquid; a sleeve that receives the bottle; and a cap, the cap is comprised of a threaded section for engaging with the bottle; a reservoir chamber for receiving a cosmetic; a barrier wall disposed between the threaded section and the reservoir chamber; a lid configured to enclose the reservoir chamber and to provide selective access to the cosmetic kit.

BRIEF DESCRIPTION OF THE DRAWINGS

The invention description below refers to the accompanying drawings, of which.

DETAILED DESCRIPTION

Figure 1:
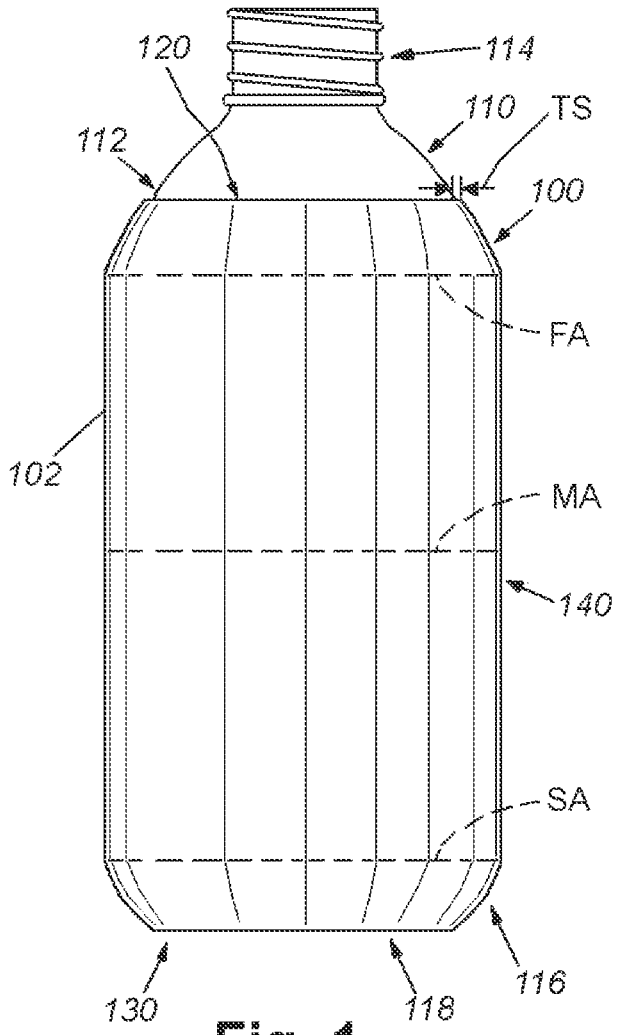
FIG. 1 is a frontal view of a bottle with a sleeve, according to a first illustrative embodiment.

FIG. 1 depicts an illustrative sleeve 100 removably attached to a bottle 110. In an embodiment, the sleeve 100 is constructed of an elastomeric polymer (for example, silicone). In an embodiment, the sleeve 100 material can be translucent and tinted with a visually pleasing color (for example, light pink or light blue). The sleeve 100 can also be adorned with patterns, logos, slogans, designs and other graphic work. The sleeve 100 can be decorative and can also be protective of the underlying bottle 110. The illustrative bottle 110 is constructed of a glass compound. In other embodiments, the bottle can be constructed of a non-glass compound. The sleeve 100 material is elastomeric and can absorb a certain amount of impact energy by compression of the material itself and by deforming its shape. The sleeve 100 is non-slippery and this enhances the consumer's grip upon the bottle and reduces the possibility that the bottle is accidently dropped.

The sleeve 100 defines a generally cylindrical shape when placed upon the bottle 110 with a first (e.g., "top") opening 120. The middle axis MA of the sleeve 100 is defined as a horizontal axis across the midpoint 140 of the sleeve, that being equidistant between the top opening 120 and a second ("base") opening 130. A first axis FA is defined as an axis that is near the top of the sleeve 100 at the point at which the shape of the bottle 110 transitions from a cylinder to a curved top portion 112, leading upwards to the neck 114. A second axis SA is defined as an axis that is near the bottom of the sleeve 100 at the point at which the shape of bottle 100 transitions from a cylinder to a curved base portion 116, leading downwards to the base 118. There is a base opening 130 at the base of the sleeve 100 that is counterpoised to the top opening. "Top" and "topmost" are each defined as a direction opposite "bottom" and "base", from the top opening 120 toward the base opening 130. "Up" and "upward" are each defined as a direction taken from the base and toward the top opening 120 with "top" being at the approximate maximum point "Down" and "downward" are each defined as a direction taken from the top opening 120 and toward the base opening 130 with "bottom" and/or "base" being at the approximate maximum point. "Interior" is defined as a region or surface facing the bottle 110 or in the open space within the sleeve 100, while "exterior" is defined as a region or surface facing away from the space of the interior and/or residing on an outside surface 102 of the sleeve and exposed to the outside environment. More generally, as used herein the directional terms, such as, but not limited to, "up" and "down", "upward" and "downward", "rearward" and "forward", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity.

The sleeve 100 has a uniform thickness TS of 1 mm when engaged with the bottle 110. The bottle 110 as shown in FIG. 1 is a bottle having an interior volume of 0.5 ml. In other embodiments, the bottle 110 can be provided with an interior volume of 1.0 ml or another size volume. A bottle system is comprised of a bottle 110 for receiving a liquid; a sleeve 100 that receives the bottle 110; and a cap 850, the cap 850 (described more fully below) is comprised of a threaded section 950 for engaging with the bottle; a reservoir chamber 900 for receiving a cosmetic 902; a barrier wall 925 disposed between the threaded section 950 and the reservoir chamber 900; a lid 804 configured to enclose the reservoir chamber 900 and to provide selective access to the cosmetic kit 800.

Figure 2:
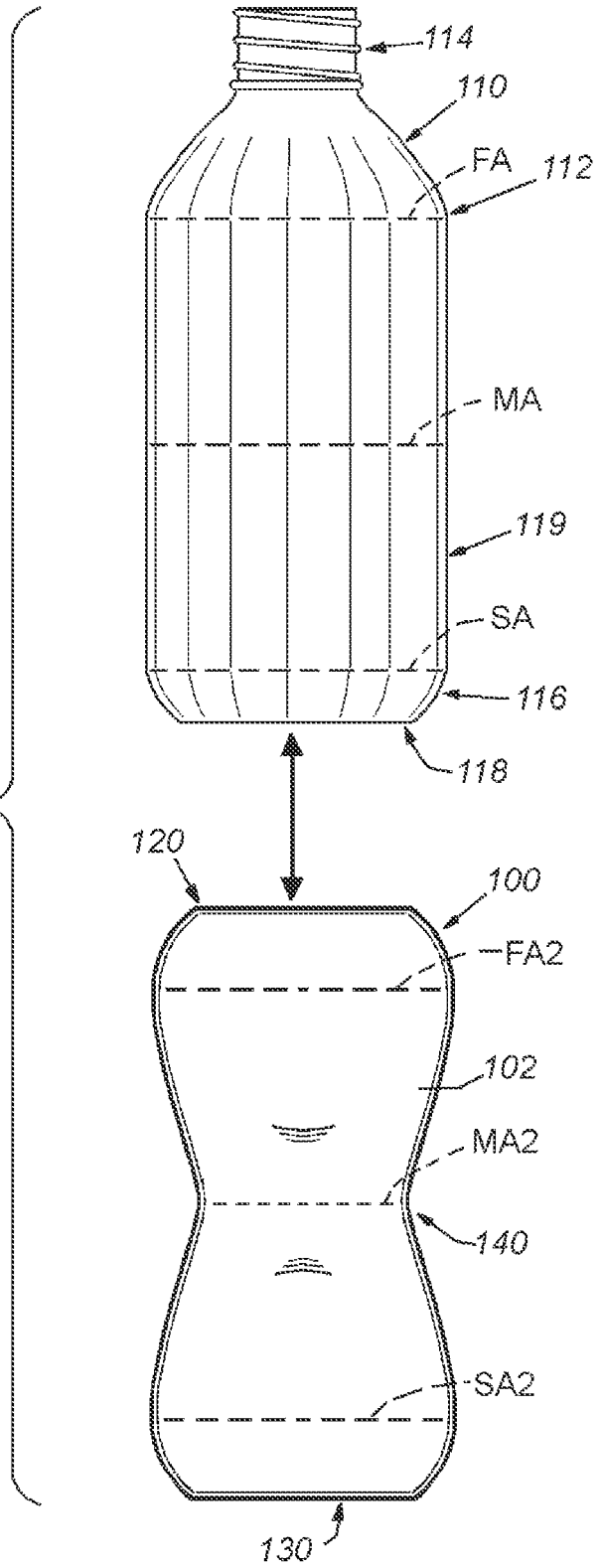
FIG. 2 is an exploded view of the bottle and the sleeve, according to the first illustrative embodiment.

FIG. 2 shows the sleeve 100 removed from the bottle 110. In this state, the sleeve and bottle can be cleaned separately. The sleeve 100 is depicted in its removed state and has a shape that is defined as an "hourglass" shape, with a diameter, circumference and cross-sectional area at the middle axis MA2 being less than a diameter of the sleeve at the first axis FA2 and openings and/or at the second axis SA2. To place the sleeve 100 over the bottle 110, the consumer places the base portion 118 of the bottle against the top opening 120 of the sleeve. The material of the sleeve 100 is elastic and can deform to stretch around the circumference of the base 118 by deformation and then passes along the curved base portion 116 to the barrel 119 of the bottle. The sleeve 100 can be manually rolled and/or unrolled, pulled, pushed or otherwise urged along the barrel 119 of the bottle until the top opening 120 passes the first axis FA and begins to retract in circumference along the curved top portion 122 until the base 118 of the bottle reaches the bottom opening 130 of the sleeve. During this engagement process, the middle axis MA2 of the sleeve deforms and the inner wall narrows (but not axis MA2) as it stretches outwardly to assume a uniform shape and thickness along the barrel 119 of the bottle 110. Removal of the sleeve 100 from the bottle 110 is followed in a reverse manner to that described above. The sleeve 100 is pliable when removed from the bottle and has a weight of about 4 ounces (113 grams). The weight of the sleeve can vary upwards or downwards, depending on the size of the sleeve and the weight of the materials.

The interior surface of the sleeve 100 is provided with a smooth texture to facilitate placing the sleeve onto the bottle and removing the sleeve from the bottle. The interior surface can include a layer of paint or other coating to enhance the removal and replacement of the sleeve. The interior surface can be machined to improve the removal and replacement. In another example, the interior surface can be textured that can engage with an exterior surface of the bottle. It is expressly contemplated that the user can exchange sleeves so that a plurality of sleeves of different designs, logos and artwork can be interchanged with one another. This interchangeability can reflect different fashions, attitudes and moods of the user. The bottle can be provided with a first sleeve that can be interchanged with a second sleeve and a multiplicity of sleeves can be provided with the bottle as part of a kit.

The "pinch" of the sleeve when not engaged with and residing on a bottle is omnidirectional and is defined as the narrowing of the sleeve at the midpoint such that the midpoint circumference and diameter of the cross-section at axis MA is less than the diameters at axes FA, SA and the openings. The diameter of the pinch is also less than the diameters of the top opening and/or the base opening. The sleeve contracts at a point equidistant from the first and second openings when removed and disengaged from the bottle.

The sleeve pinch is also a fold line across the body of the sleeve 100 and facilitates folding of the sleeve so that both end openings are in proximity to each other. This reduces the overall size and profile of the sleeve. The reduced size sleeve can be shipped more readily from the source of production and/or distribution to retailers and other distributors because the reduced size takes up a smaller volume than an unfolded sleeve and more can be placed into a shipping package, or a smaller package can be used. At the same time, the folded reduced volume saves on inventory storage. The resilient material of the sleeve unfolds without a permanent creasing and is readily placed onto a container.

Figure 3:
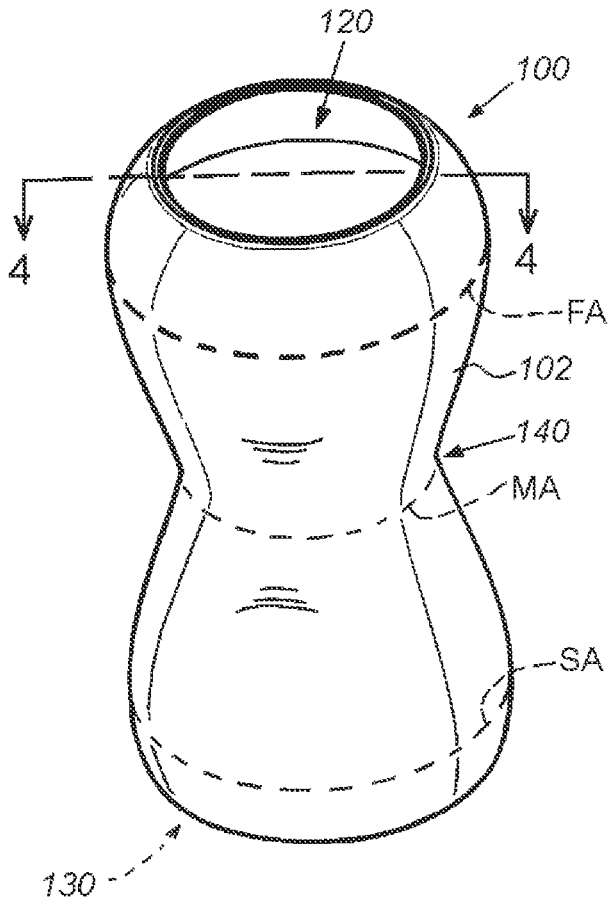
FIG. 3 is a perspective view of the sleeve, according to the first illustrative embodiment.

FIG. 3 is a perspective view of the illustrative sleeve 100 showing the top opening 120. The midpoint 140 defines a waist with a uniform (omnidirectional) pinch.

Figure 4:
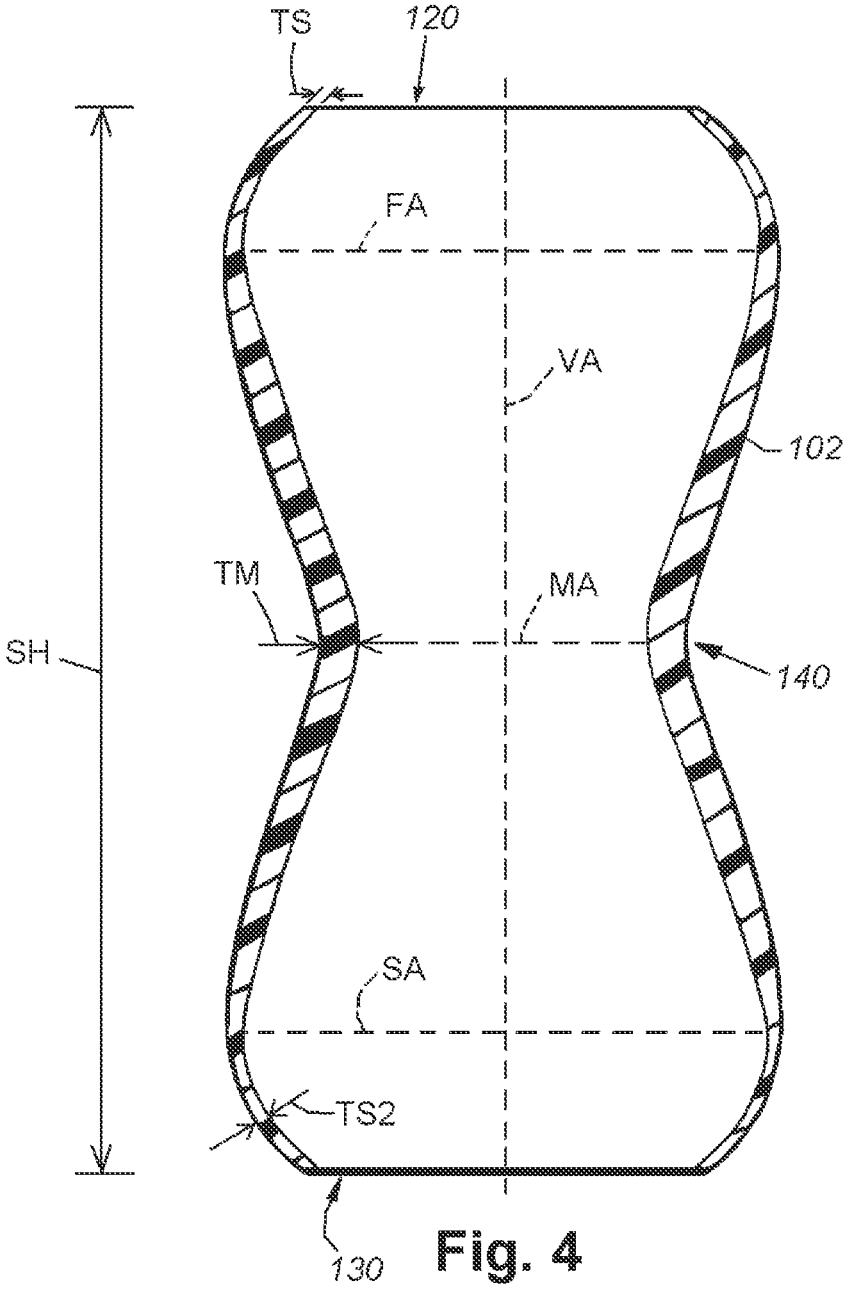
FIG. 4 is a cross-section view of the sleeve along the lines 4-4 of FIG. 3, according to the first illustrative embodiment.

FIG. 4 is a cross-section of the illustrative sleeve 100 along a vertical axis VA. The sleeve height SH is approximately 6 inches (15 cm) from the base opening 130 to the top opening 120. This height will vary depending on the size of the contained water bottle. For example, a sleeve enclosing a water bottle having a volumetric size of 1 liter has a greater height and overall size than a sleeve enclosing a bottle with a volumetric size of 0.5 liter. As stated above, the sleeve thickness TS at the top opening is approximately 1 mm. The sleeve thickness TS2 at the base opening 130 is also approximately 1 mm. The sleeve thickness tapers from its narrowest thicknesses at the top and base openings 120, 130 to a midpoint thickness TM of approximately 5 mm. The taper is uniform and omnidirectional from the relatively thin end openings to the relatively thick midpoint. When the sleeve 100 is placed onto the bottle, the sleeve stretches and the thickness at the midpoint transitions from 5 mm to 1 mm as the material uniformly stretches. In this embodiment, the stretching involves a uniform elastomeric deformation of the sleeve material. In other embodiments, the stretching can be accomplished with a vertical corrugation comprised of a plurality of vertical cuts in the material along the interior surface. The pinched waist of the sleeve 100 at the midpoint 140 is thus a thick waist that stretches outward to accommodate the enclosed bottom and contributes to a snug fit for the sleeve on the bottle.

Figure 5:
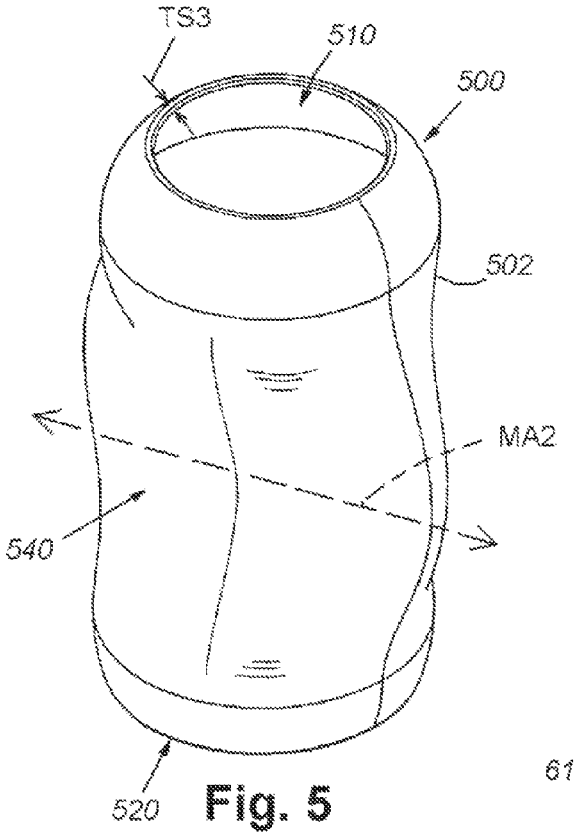
FIG. 5 is a perspective view of a sleeve, according to a second embodiment.
Figure 6:
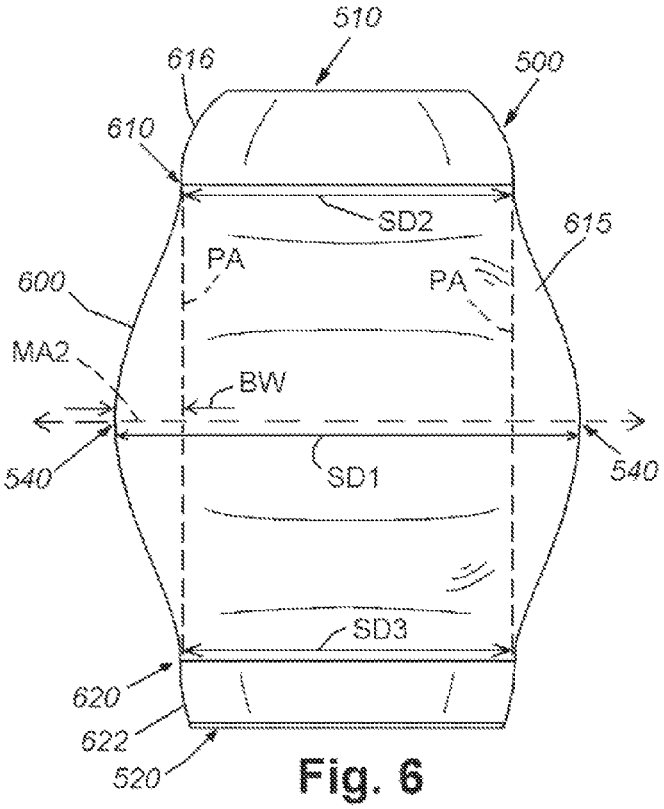
FIG. 6 is a front view of the sleeve, according to the second embodiment.
Figure 7:
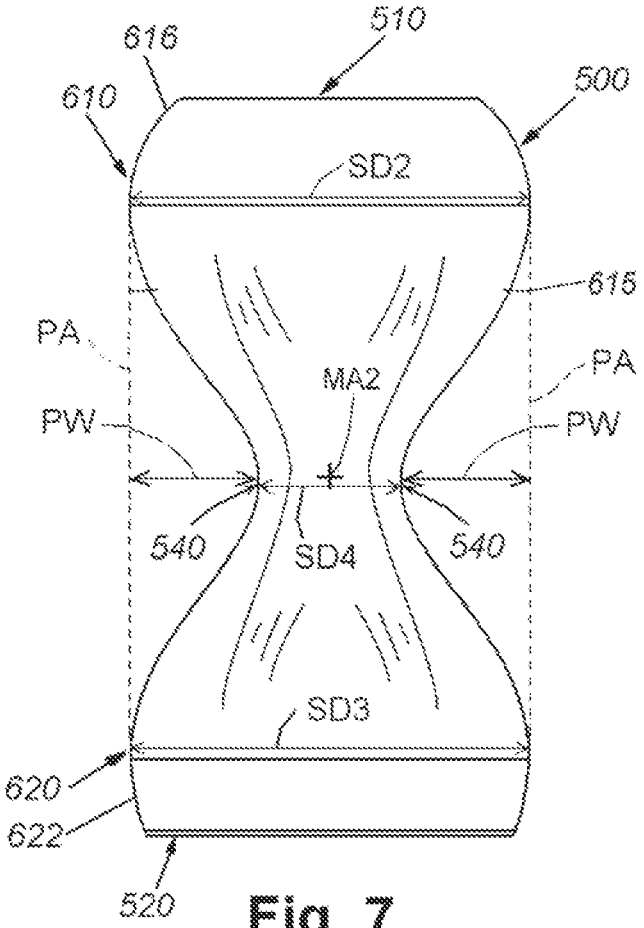
FIG. 7 is side view of the sleeve, according to the second embodiment.

FIGS. 5-7 depict an alternate embodiment of the sleeve that is defined by a pinch at the midpoint that is along an axis (e.g., "monoaxial" in orientation), in contrast to the omnidirectional pinch as set forth above. With regard to FIG. 5, a sleeve 500 is provided with a uniform thickness TS3 of approximately 1 mm along the entire body 502 of the sleeve 500. The sleeve is provided with a top opening 510 and a base opening 520. At the midpoint 540, being defined as equidistant from the top opening 510 and the base opening 520, the sleeve is pinched along a midpoint axis MA2. The midpoint axis MA2 is a horizontal axis that transects the sleeve 500. The material of the sleeve is constructed so that when the sleeve is removed from the bottle, as depicted in FIGS. 5-7, there is a noticeable pinch at the midpoint.

FIG. 6 shows the pinch at the midpoint 540 in a front view. The exterior surface 600 of the sleeve 500 bulges at the midpoint 540 along axis MA2. The perimeter axis PA is a vertical axis drawn along the outer surface of the sleeve 500 when the sleeve is engaged with and residing on a water bottle and passes from a top shoulder point 610, where the sleeve geometry when residing on a bottle transitions from a cylindrical sleeve along the middle 615 of the sleeve to a first portion 616, defined as a top shoulder segment, to a bottom shoulder 620 where the sleeve geometry when residing on a bottle transitions from a cylindrical sleeve along the middle 615 of the sleeve to a second portion 622, defined as a bottom shoulder. The bulge at the midpoint 540 has a bulge width BW of approximately 1 inch (2.5 cm). The bulge is formed along axis MA2 and is monoaxial. The diameter of the sleeve SD1 from a midpoint 540 at one end of the axis to a midpoint 540 at the opposite end along the axis is greater than at least one of the diameter SD2 at top shoulder point 610 and diameter SD3 at bottom shoulder point 620 and the diameter of the top opening and/or the base opening. The sleeve geometry transitions from a pinch to cylindrical by engagement with the exterior of the water bottle. Placing the sleeve 500 onto the bottle and removing the sleeve follows the procedure as set forth above with the exception in this embodiment, it is the shape that changes, not the thickness.

FIG. 7 is a side view of the sleeve of FIG. 5 and depicts the axis MA2 as a point. The width PW is the difference between the perimeter axis PA and the midpoint 540. Width PW is approximately 1 inch (2.5 cm). Widths BW and PW will vary depending on the volumetric size of the engaged and enclosed water bottle. The diameter of the sleeve SD4 from a midpoint 540 at one side of the axis to a midpoint 540 at the opposite side across the axis is less than at least one of the diameter SD2 at top shoulder point 610 and diameter SD3 at bottom shoulder point 620. Thus, the diameter of the sleeve 500 at the midpoint 540 is at the same time both greater and lesser than the diameters at the top shoulder point 610 and the bottom shoulder point 620.

Figure 8:
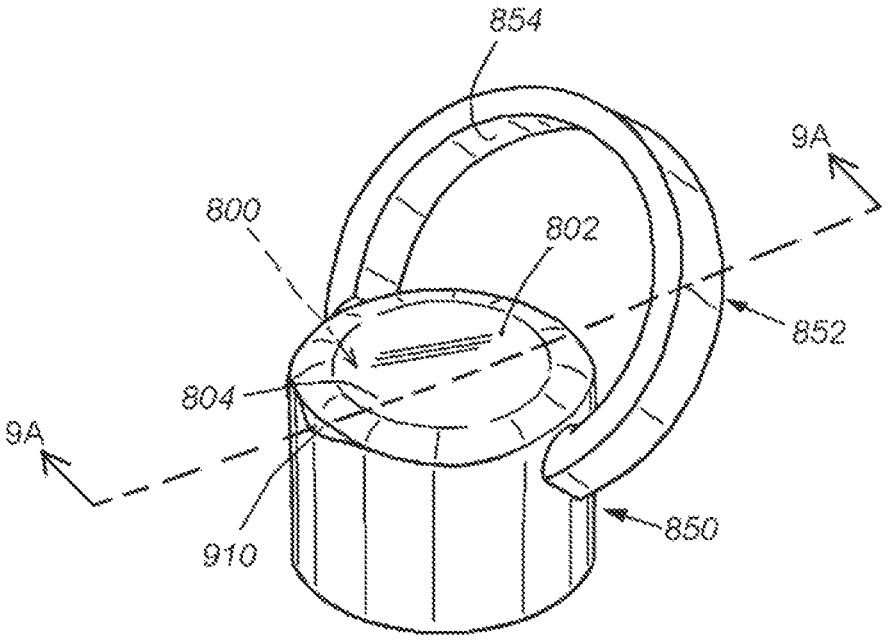
FIG. 8 is a perspective view of a closed cap with a cosmetic kit, according to an illustrative embodiment.
Figure 9:
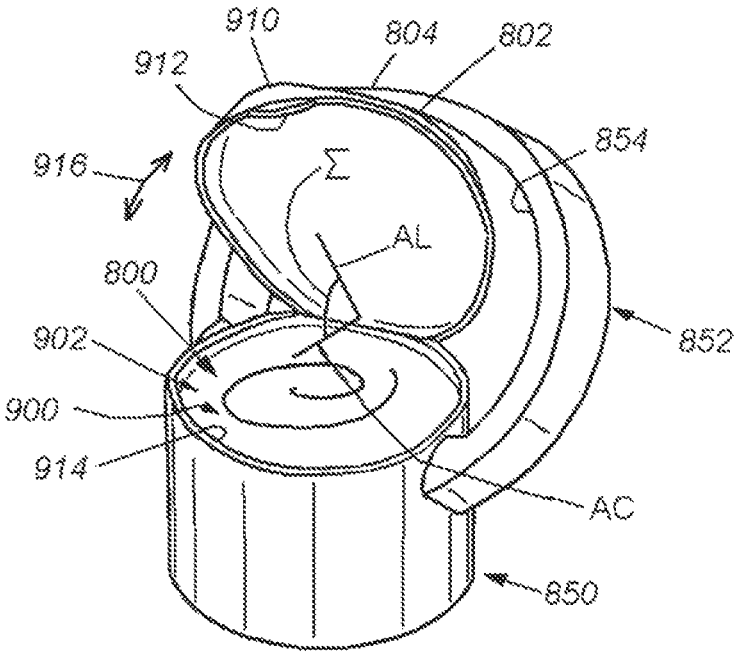
FIG. 9 is a perspective view of an open cap with a cosmetic kit, according to the illustrative embodiment.

FIG. 8 depicts a cap 850 for a bottle (a bottle as described above), with a contained cosmetic kit 800. The cap 850 can be formed of a material similar to the sleeve. The cap 850 is generally cylindrical and shown in a closed configuration in FIG. 8. In the closed configuration, the lid 804 at least partially or completely covers the cosmetic kit 800, thereby preventing access to the cosmetic kit and preventing unwanted particulates from contaminating the cosmetic kid. The cosmetic kit 800 can be comprised of one or more cosmetics. The cap is comprised of a threaded section 950 for engaging with the bottle; a reservoir chamber 900 for receiving a cosmetic 902; a barrier wall 925 disposed between the threaded section 950 and the reservoir chamber 900; a lid 804 configured to enclose the reservoir chamber 900 and to provide selective access to the cosmetic kit. FIG. 9 shows the cap an open configuration, whereby the lid 804 is unlocked and opened, thereby providing access to the cosmetic kit 800. The cap 850 can be engaged with a bottle in both the closed and open configurations as well as during use and/or refilling of the cosmetic kit. The cosmetic 902 received within the reservoir chamber 900 can be depleted and subsequently refilled. The cap with cosmetic kit can be washed along with the sleeve in a dishwashing machine or by hand.

In addition to the function of providing access to the cosmetic kit, the cap also serves to contain the contents of a water bottle and prevent materials from leaving or entering the bottle. In this regard, the cap can be threaded along a portion of the interior and an enclosed cosmetic kit is fitted above the threading and under the top surface 802 of the cap 850. The illustrative cap 850 is provided with an openable lid 804 that is hinged. In other embodiments, the lid 804 is snap fitted and held in place by tension. The cap 850 is provided with a handle 852 that can be arc-shaped and is arranged at a pre-set offset angle relative to the orientation of the cap 850. In an embodiment, the angle of the handle 852 is approximately sixty (60) degrees relative to the vertical orientation of the cap. In other embodiments, the offset angle can be greater or lesser. The interior surface 854 of the handle functions as a stop for a hinged lid 804. The lid 804 can be opened until the top surface 802 comes into contact with the inner surface 854 of the handle, as shown in FIG. 9. The lid 804, cap 850 and handle 852 are unitary in construction and are constructed of the same material. In an alternate embodiment, the top surface 802 is provided with a decorative motif, for example, a brand logo.

A method for carrying and dispensing cosmetics within a cap for a bottle is comprised of the steps of opening a lid 804 and filling a cosmetic reservoir 900 within the cap 850 with a cosmetic 902; opening the lid 804 to access and remove a portion of the cosmetic 902 from the cosmetic reservoir 900; and applying the cosmetic; and closing the lid 804. The opening of the lid 804 is stopped by contact with the handle 852.

With reference to FIG. 9, the lid 804 is opened until making contact with the handle 852 and the maximum angle Σ of opening is described as the angle between an axis AL drawn along the plane of the top surface 802 and an axis AC drawn along the plane of the top of the cap 850 and is approximately 60 degrees. When the lid is closed, angle Σ is zero degrees. In other embodiments, measurement of angle Σ when the lid is open is greater or lesser than 60 degrees. The opening of the lid provides access to a cosmetic reservoir that resides within an inner volume of the cap. The illustrative cosmetic kit 800 is provided with a single cosmetic reservoir 900 that can contain at least one cosmetic 902 (for example, a lip gloss product). As used herein, the content of the cosmetic reservoir can include, but is not limited to lip gloss, lip balm, hair gel, cover up, base foundations, blush, eye shadow, sun screen, pills, and the like. The lid 804 is held in a closed orientation by tension from a locking lip 912 against the inner perimeter 914 of the cap and is released by the user placing a fingernail or digit against a tongue 910 that is part of the lid and exerting pressure to pop the lid open, causing a release of the locking lip 912 and free movement 916 of the lid. When the lid is open, the user can dispense a portion of the cosmetic with a finger or an applicator and apply the cosmetic to his or her person. The closing of the lid creates an annular seal to contain the enclosed cosmetics. When a sufficient amount of cosmetic has been removed, the user closes the lid by pressing it downward until the locking lip engages the inner perimeter 914 and snaps in a closed configuration. The illustrative cosmetic reservoir 900 is formed as part of the cap 850 and is refillable by the user. It is expressly contemplated that the bottle with cap can be provided with an existing cosmetic already residing in the reservoir 900 and a supply of premeasured cosmetic refills as part of a kit.

Figure 9A:
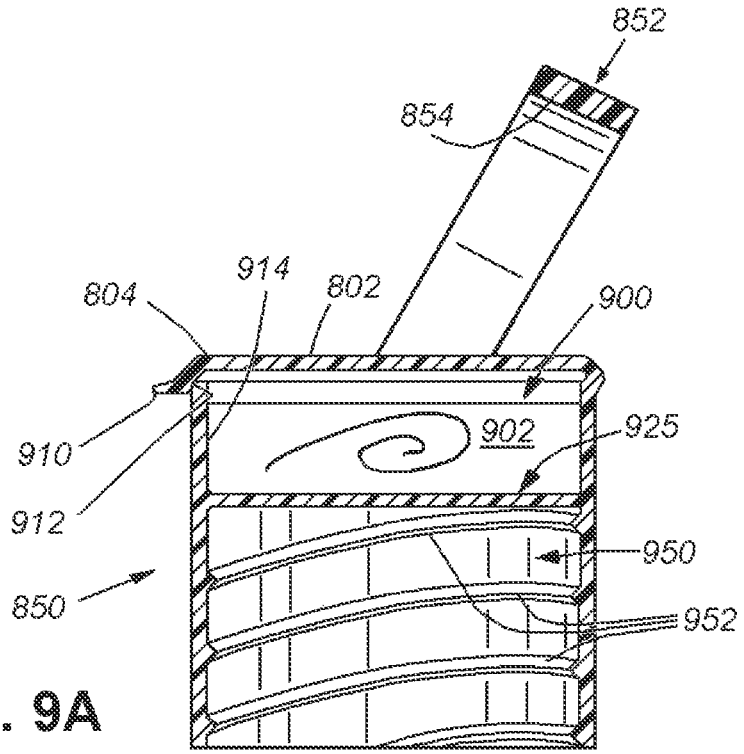
FIG. 9A is a cross-section view of a cap with a cosmetic kit along lines 8-8 of FIG. 8, according to the illustrative embodiment.

FIG. 9A is a cross section view of the cap showing the cap 850 with a threaded cap interior 950, a cosmetic reservoir 900 and a barrier wall 925 therebetween that divides the cosmetic reservoir and the cap interior. The cap interior 950 is provided with threading 925 that is compatible with the threading on the bottle (not shown). In an embodiment, the cosmetic 902 is placed directly into the reservoir 900. In another embodiment, the cosmetic 900 is provided in a refillable open-topped tray that is sized to be placed within the reservoir 900.

Figure 10:
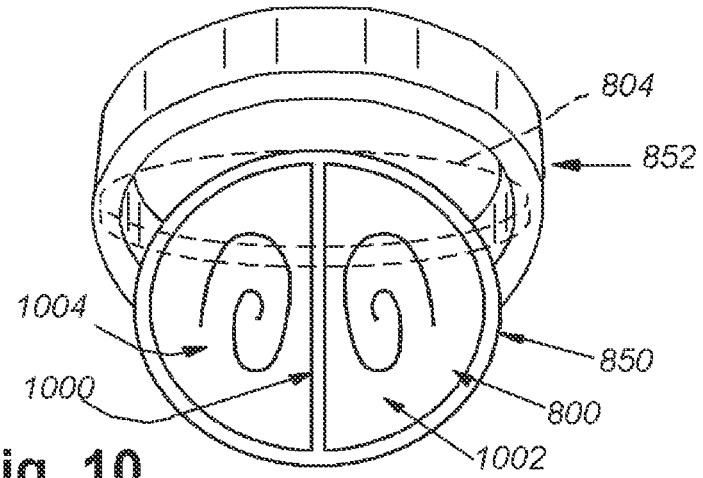
FIG. 10 is a top view of a cap with a cosmetic kit that includes two cosmetic reservoirs, according to an illustrative embodiment.

FIG. 10 shows a cosmetic kit 800 that is constructed with a central septum, or dividing wall 1000 so that there are two cosmetic reservoirs 1002, 1004. The lid 804 is shown in broken lines so that the septum 1000 is clearly seen. The cosmetic reservoirs 1002, 1004 are shown as hemispherical shape of equal size. Both reservoirs are formed in the top of the cap and are non-removable. In other embodiments, the reservoirs can be of unequal sizes and removable as cups. It is further contemplated that the septum can be a circular wall, so that there are concentric nestled reservoirs, with one outside of the other. It is contemplated that the cosmetic reservoirs 1002, 1004 can retain two discrete cosmetics, for example, a foundation base in one and a lip gloss in the other.

Figure 11:
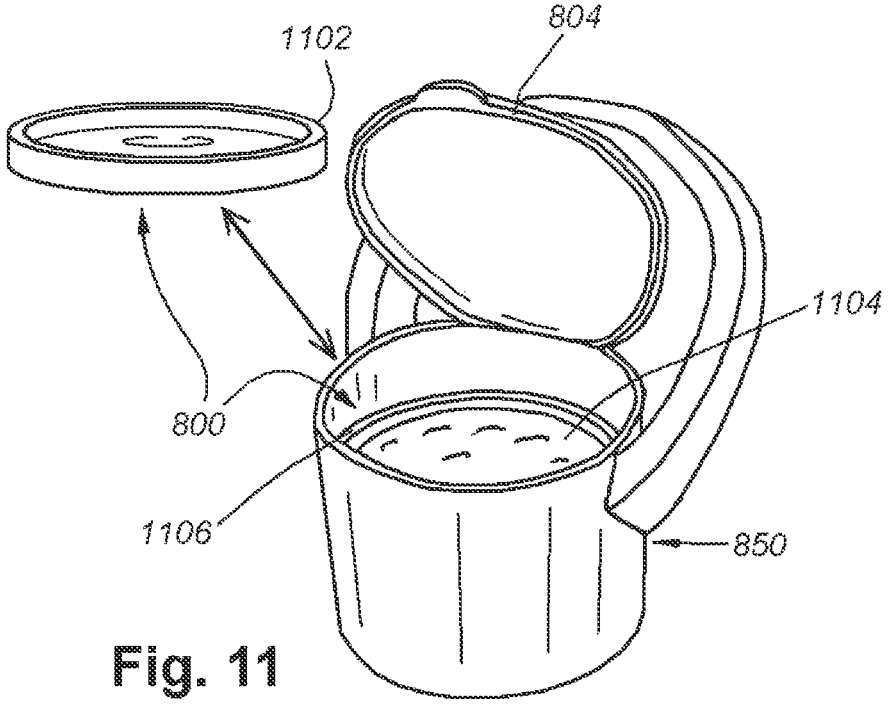
FIG. 11 is a perspective view of a cosmetic kit with stacked cosmetic reservoirs, according to an illustrative embodiment.

FIG. 11 depicts a cosmetic kit 800 with two cosmetic reservoirs 1102, 1104 that are stacked one upon the other. Reservoir 1102 is a removable tray that can be withdrawn from the cap to provide access to reservoir 1104. Reservoir 1104 is formed as part of the cap 850. Reservoir 1104 is provided with a circumferential lip 1106 to support reservoir 1102 when stacked. It is contemplated that reservoir 1102 is fitted into the cap with a snug fit to prevent it from rattling within the cap during movement.

Figure 12:
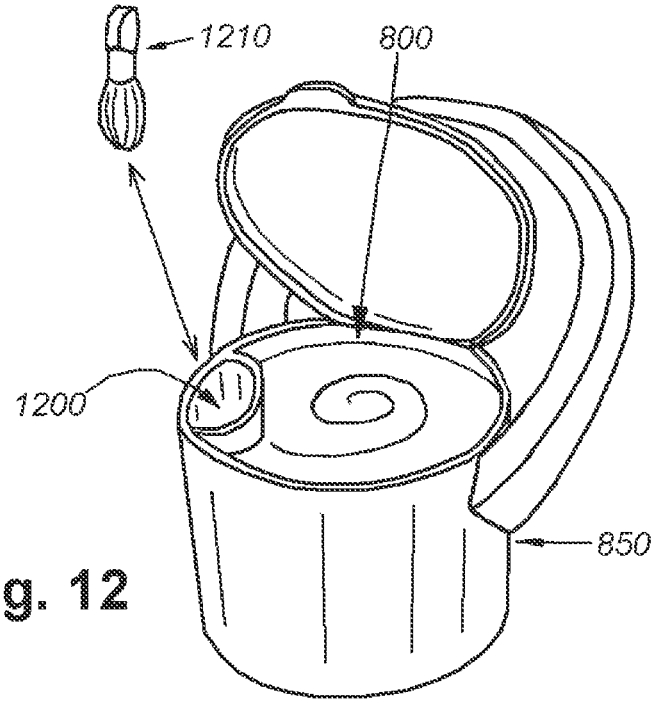
FIG. 12 is a perspective view of a cosmetic kit with an applicator, according to an illustrative embodiment.

FIG. 12 shows a cap 850 with a single reservoir 800 that is constructed with a well 1200 for carrying an applicator 1210. The applicator 1210 can be a small brush, a sponge or another applicator. The applicator well 1200 can include a simple spring loaded device to ease removal of the applicator 1210 when in use, or to hold the applicator under tension and abate rattles while in movement.

It should be clear from the foregoing that the cap with cosmetic kit as set forth above provides a readily available source of cosmetics whenever the bottle is carried. The cap closes the top of the bottle and contains a cosmetic kit. The kit can be readily accessed and reservoir is easily refilled.

The foregoing has been a detailed description of illustrative embodiments of the invention. Various modifications and additions can be made without departing from the spirit and scope of this invention. Features of each of the various embodiments described above can be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, a small removable mirror can be carried within the lid and above the reservoir. An applicator can be carried within the lid. A plurality of stacked reservoirs can be provided and the stacked reservoirs can be divided with septum into smaller reservoirs. The cap can be made taller to provide a deeper reservoir. Accordingly, this description is meant to be taken only by way of example, and not to otherwise limit the scope of this invention.

What is claimed is:

1. A cap for a bottle comprising:

a threaded section for engaging with the bottle;

a reservoir chamber for receiving a cosmetic;

a barrier wall disposed between the threaded section and the reservoir chamber;

a lid configured to enclose the reservoir chamber, the lid having a hinge that freely moves between a closed position and an open position based upon force applied by a user, the lid being retained in the closed position by a snap fit in which a locking lip engages a formation on a perimeter of the cap, and the lid is selectively positionable in the open position by a pressurable motion of the user moving the hinge freely to the open position to provide selective access to the cosmetic in the open position; and an arc-shaped handle, unitarily formed with the cap extending from opposite sides of the cap beneath the lid, the handle being off set at an angle relative to the cap, wherein a portion of the handle is located to act as a stop to the lid in the open position that restricts hinged movement beyond a predetermined open angle.

2. The cap of claim 1, wherein the cosmetic received within the reservoir chamber can be depleted and subsequently refilled.

3. The cap of claim 1, further comprising a removable tray received within the reservoir chamber, the removable tray being configured to receive the cosmetic.

4. The cap of claim 1, wherein the reservoir chamber comprises a dividing wall that defines a plurality of distinct reservoir chambers for receiving a plurality of cosmetics.

5. The cap of claim 1, wherein the reservoir chamber comprises at least two reservoirs that are stacked, one upon the other.

6. The cap of claim 1, wherein the handle is off set at an angle of 60 degrees relative to a plane defined by a top surface of the cap.

7. The cap of claim 1 wherein the hinge is arranged to move flexibly between the open position and the closed position, extending unitarily from the lid to a location along a side of the cap.

8. A method for carrying and dispensing cosmetics within a cap for a bottle, the method comprising:

opening a lid by overcoming a snap fit between a lip on the lid and a formation on a perimeter of the cap and pressurably moving the lid, freely moving on a hinge, to an open position and filling a cosmetic reservoir within the cap with a cosmetic;

subsequently opening the lid by overcoming the snap fit between the lip on the lid and the formation on a perimeter of the cap and pressurably moving the lid, freely moving on the hinge, to an open position to access and remove a portion of the cosmetic from the cosmetic reservoir;

applying the cosmetic; and closing the lid by pressurably moving the lid, freely moving on the hinge to a closed position and engaging the lip with the formation with the snap fit, wherein the opening of the lid is stopped by contact with an arc-shaped handle, unitarily formed with the cap, that extends from opposing positions beneath the lid on a side of the cap, a portion of which handle engages a portion of the lid in the open position to restrict hinged movement beyond a predetermined open angle.

9. The method of claim 8, wherein the closing of the lid creates an annular seal to contain the enclosed cosmetics.

10. The method of claim 8 wherein the hinge is arranged to move flexibly between the open position and the closed position, extending unitarily from the lid to a location along a side of the cap.

11. A bottle system, comprising:

a bottle for receiving a liquid;

a sleeve that receives the bottle;

a cap, the cap comprising, a threaded section for engaging with the bottle, a reservoir chamber for receiving a cosmetic, a barrier wall disposed between the threaded section and the reservoir chamber, and a lid configured to enclose the reservoir chamber, the lid having a hinge that freely moves between a closed position and an open position based upon force applied by a user, the lid being retained in the closed position by a snap fit in which a locking lip engages a formation on a perimeter of the cap, and the lid is selectively positionable in the open position by a pressurable motion of the user to moving the hinge freely to the open position to provide selective access to the cosmetic; and an arc-shaped handle extending upwardly from the lid on opposing edges of the cap beneath lid and defining a top portion that interferes with hinged movement of the lid in the open position beyond a predetermined open angle.

12. The bottle system of claim 11 wherein the lid defines an annular seal to contain the enclosed cosmetics in the closed position with the snap fit engaged.

13. The bottle system of claim 12 wherein the handle is unitarily formed with the cap.

14. The bottle system of claim 11 wherein the hinge is arranged to move flexibly between the open position and the closed position, extending unitarily from the lid to a location along a side of the cap.

* * * * *